US010293909B1

(12) United States Patent
Takeda

(10) Patent No.: US 10,293,909 B1
(45) Date of Patent: May 21, 2019

(54) OUTBOARD MOTOR

(71) Applicant: YAMAHA HATSUKOKI KABUSHIKI KAISHA, Iwata-shi, Shizuoka (JP)

(72) Inventor: Yukio Takeda, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/935,254

(22) Filed: Mar. 26, 2018

(30) Foreign Application Priority Data

Nov. 6, 2017 (JP) ..... 2017-213758

(51) Int. Cl.
*B63H 20/14* (2006.01)
*B63H 23/00* (2006.01)
*B63H 20/20* (2006.01)
*B63H 20/32* (2006.01)

(52) U.S. Cl.
CPC ..... *B63H 20/20* (2013.01); *B63H 20/32* (2013.01); *B63H 2020/323* (2013.01)

(58) Field of Classification Search
CPC ..... B63H 20/14; B63H 20/20; B63H 20/22; B63H 20/32; B63H 2020/14; B63H 2020/32; B63H 2020/323
USPC ..... 440/75, 83, 86
See application file for complete search history.

(56) References Cited

U.S. PATENT DOCUMENTS 5,403,218 A * 4/1995 Onoue ..... B63H 20/002 192/48.91
5,449,306 A * 9/1995 Nakayasu ..... B63H 5/10 192/48.7
5,888,108 A * 3/1999 Iriono ..... B63H 5/10 416/134 R
5,921,828 A * 7/1999 Ogino ..... B63H 5/10 192/48.7
7,704,183 B2 * 4/2010 Nakamura ..... B63H 5/10 440/80
8,157,694 B2 * 4/2012 Nakamura ..... B63H 5/10 440/75
2008/0233815 A1 * 9/2008 Nakamura ..... B63H 5/10 440/86

FOREIGN PATENT DOCUMENTS

JP 2012-144186 A 8/2012

* cited by examiner

*Primary Examiner* — Daniel V Venne
(74) *Attorney, Agent, or Firm* — Keating and Bennett, LLP

(57) ABSTRACT

An outboard motor includes a shift rod including a first rod, a second rod, and a joint. The first rod extends in a vertical direction. The second rod extends in the vertical direction and is located below the first rod. The second rod is disposed eccentrically with respect to the first rod. When viewed in a plan view, the second rod overlaps with at least a portion of the first rod or is in contact with the first rod. The joint connects the first rod to the second rod.

12 Claims, 9 Drawing Sheets

OUTBOARD MOTOR

CROSS REFERENCE TO RELATED APPLICATIONS

This application claims the benefit of priority to Japanese Patent Application No. 2017-213758 filed on Nov. 6, 2017. The entire contents of this application are hereby incorporated herein by reference.

BACKGROUND OF THE INVENTION

1. Field of the Invention

The present invention relates to an outboard motor.

2. Description of the Related Art

Outboard motors are provided with a gear mechanism that connects a drive shaft to a propeller shaft. For example, the gear mechanism switches the transmission direction of rotation to the propeller shaft by switching gears that connect the drive shaft to the propeller shaft. A shifter is operated to switch the gears of the gear mechanism. A shift rod is connected to the shifter. The shifter is operated by manual operation by an operator or operational force by an actuator being transmitted via the shift rod to the shifter. As a result, the connection of the gear mechanism is switched.

A typical measure implemented to improve the durability of the drive system of an outboard motor is to reduce the load on each component by increasing the size of the gears, bearings, and other components that transmit driving force. However, increasing the size of these components requires expanding the distance between the drive shaft and the shift rod which, in turn, necessitates that the position of the shift rod be changed.

When the shift rod has a straight line shape extending from the cowling to the lower case, substantial changes in the overall structure of the outboard motor must be made in order to change the position of the shift rod. These changes result in increases in the weight and/or increases in the external size of the outboard motor.

A solution to this problem is proposed in JP-A-2012-144186. With the outboard motor of JP-A-2012-144186, the shift rod includes an upper shift rod and a lower shift rod. The lower shift rod is disposed forward of the upper shift rod. Gears are fixed to each of the lower shift rod and the upper shift rod. The gear of the lower shift rod and the gear of the upper shift rod are in engagement with each other. The rotation of the upper shift rod is transmitted to the lower shift rod via these gears.

However, with the structure described above, a distance is needed to dispose the gears between the lower shift rod and the upper shift rod. Accordingly, this structure cannot be used when the distance between the axes of the two shift rods is equal to or less than the diameter of each rod. Additionally, when the distance between the axes of the two shift rods is increased in order to enable the use of this structure, a problem occurs in that the external shape of the outboard motor becomes unnecessarily large.

SUMMARY OF THE INVENTION

Preferred embodiments of the present invention improve durability of drive systems and prevent increases in the sizes of outboard motors while avoiding substantial changes to the structures of the outboard motors.

An outboard motor according to a preferred embodiment of the present invention includes an engine, a drive shaft, a propeller shaft, a gear mechanism, a shifter, and a shift rod. The drive shaft extends downward from the engine. The propeller shaft extends in a front-back direction. The gear mechanism connects the drive shaft to the propeller shaft. The shifter to switches the connection of gears of the gear mechanism. The shift rod is connected to the shifter, and operates the shifter.

The shift rod includes a first rod, a second rod, and a joint. The first rod extends in a vertical direction. The second rod extends in the vertical direction and is located below the first rod. The second rod is disposed eccentrically with respect to the first rod. When viewed in plan view, the second rod overlaps with at least a portion of the first rod or is in contact with the first rod. The joint connects the first rod to the second rod.

With the outboard motor according to the above preferred embodiment, the second rod is disposed eccentrically with respect to the first rod. Therefore, compared to a configuration in which the shift rod has a straight line shape, it is possible to reliably provide a distance between the second rod and the drive shaft while avoiding substantial changes to the structure of the outboard motor. As a result, the durability of the drive system is improved. Additionally, when viewed in a plan view, the second rod overlaps with at least a portion of the first rod or is in contact with the first rod. That is, the first rod and the second rod are disposed in closer proximity to each other than in a configuration in which the first rod and the second rod are connected by gears. As a result, an increase in the size of the outboard motor is prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
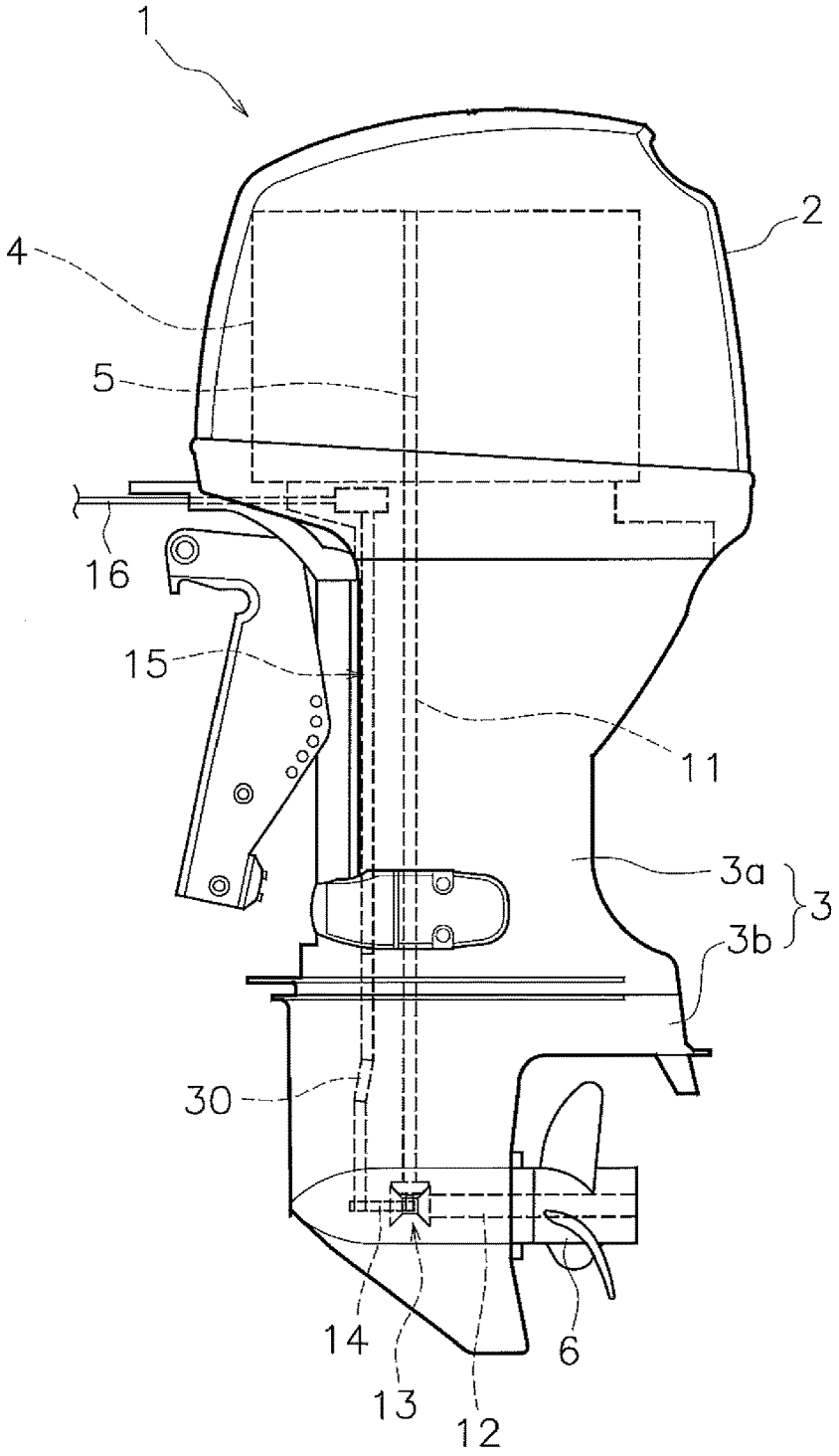
FIG. 1 is a side view of an outboard motor according to a preferred embodiment of the present invention.

Hereinafter outboard motors according to preferred embodiments of the present invention will be described with reference to the attached drawings. FIG. 1 is a side view of an outboard motor 1 according to the present preferred embodiment. The outboard motor 1 includes an engine cover 2, a case 3, and an engine 4. The engine cover 2 houses the engine 4. The case 3 is disposed below the engine cover 2.

The case 3 includes an upper case 3*a* and a lower case 3*b*. The upper case 3*a* is disposed below the engine cover 2. The lower case 3*b* is disposed below the upper case 3*a*. The engine 4 is disposed within the engine cover 2. The engine 4 includes a crank shaft 5. The crank shaft 5 extends in an up-down direction.

The outboard motor 1 further includes a drive shaft 11, a propeller shaft 12, and a gear mechanism 13. The drive shaft 11 is connected to the crank shaft 5. The drive shaft 11 is disposed within the case 3. The drive shaft 11 extends downward from the engine 4. The drive shaft 11 extends in the up-down direction within the case 3.

The propeller shaft 12 is disposed in the lower case 3*b*. The propeller shaft 12 extends in a front-back direction. The propeller shaft 12 is connected to a propeller 6. The gear mechanism 13 is disposed within the lower case 3*b*. The gear mechanism 13 connects the drive shaft 11 to the propeller shaft 12. Rotation of the drive shaft 11 is transmitted to the propeller shaft 12 via the gear mechanism 13. The gear mechanism 13 switches the rotation direction of motive power transmitted from the drive shaft 11 to the propeller shaft 12.

The gear mechanism 13 switches between a forward state, a reverse state, and a neutral state. In the forward state, the gear mechanism 13 transmits the rotation of the drive shaft 11 to the propeller shaft 12 in a direction so as to advance the boat on which the outboard motor 1 is mounted. In the reverse state, the gear mechanism 13 transmits the rotation of the drive shaft 11 to the propeller shaft 12 in a direction so as to reverse the boat. In the neutral state, the gear mechanism 13 causes the outboard motor 1 to idle without transmitting the rotation the drive shaft 11 to the propeller shaft 12.

The outboard motor 1 further includes a shifter 14 and a shift rod 15. The shifter 14 switches the connection of the gear mechanism 13. The shift rod 15 is connected to the shifter 14, and operates the shifter 14. The shift rod 15 extends upward from the shifter 14. The shift rod 15 is connected to a shift cable 16. The shift cable 16 is connected to a shift lever (not illustrated in the drawings). Operations of the shift lever by an operator are transmitted to the shift rod 15 via the shift cable 16. As a result, the shift rod 15 rotates around the axis of the shift rod 15. The gear mechanism 13 switches between the forward state, the reverse state, and the neutral state as a result of the shifter 14 moving in accordance with the rotation of the shift rod 15. Note that, the shift rod 15 may be connected to an actuator such as an electric motor, an electric cylinder, a hydraulic motor, and a hydraulic cylinder.

Figure 2:
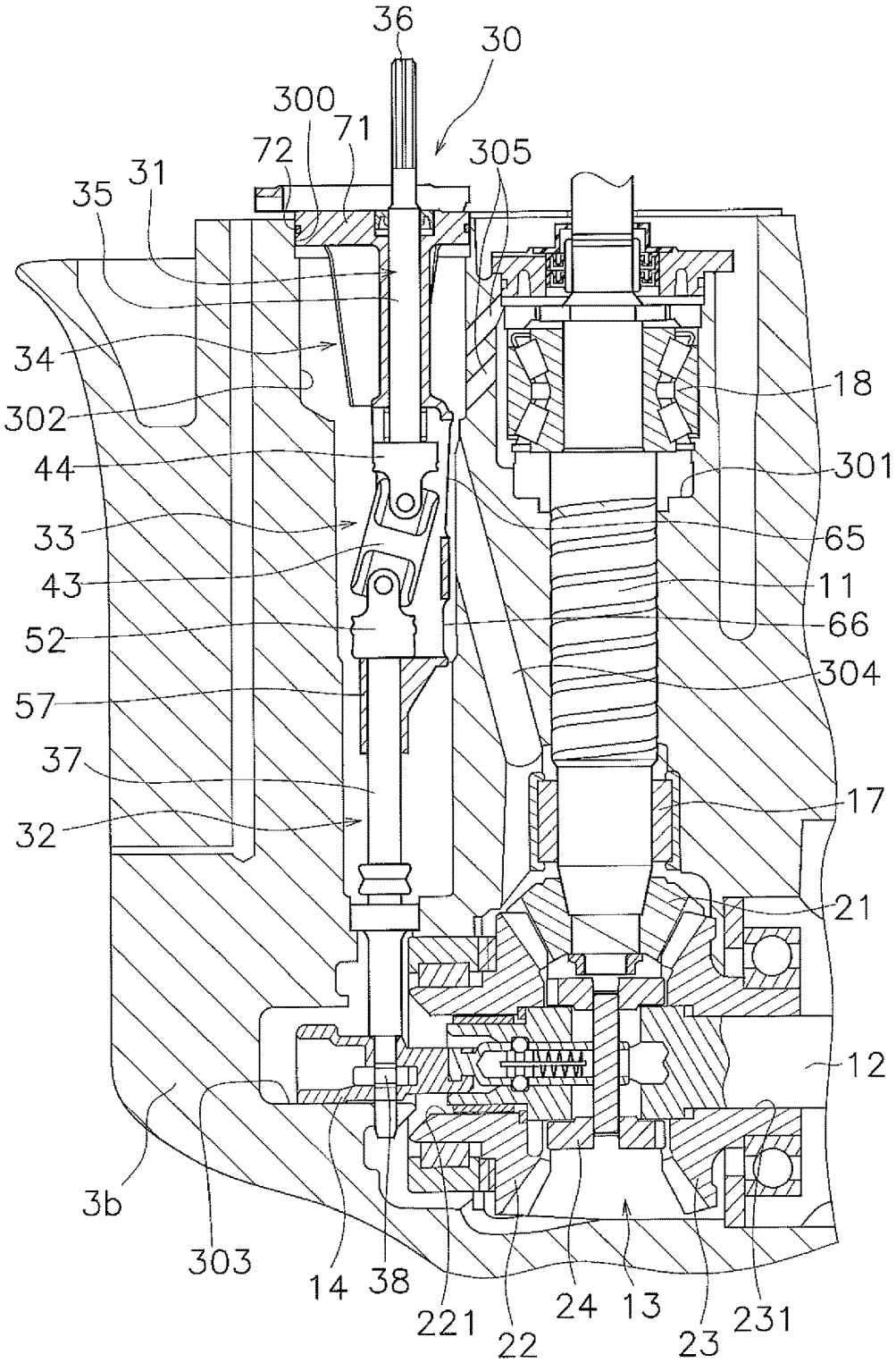
FIG. 2 is a cross-sectional view illustrating the structure of a lower case.

FIG. 2 is a cross-sectional view illustrating the structure of the lower case 3*b*. As illustrated in FIG. 2, the drive shaft 11 is partially disposed within the lower case 3*b*. A lower bearing 17 and an upper bearing 18 are disposed within the lower case 3*b*. The lower bearing 17 is disposed above the gear mechanism 13 and rotatably supports the drive shaft 11. The upper bearing 18 is disposed above the lower bearing 17 and rotatably supports the drive shaft 11.

The gear mechanism 13 includes a drive gear 21, a forward gear 22, a reverse gear 23, and a dog clutch 24. The drive gear 21 is fixed to a lower end of the drive shaft 11. The forward gear 22 and the reverse gear 23 are disposed side-by-side in an axial direction of the propeller shaft 12. The forward gear 22 and the reverse gear 23 are disposed concentrically with the propeller shaft 12. The drive gear 21 is disposed between the forward gear 22 and the reverse gear 23, and is engaged with the forward gear 22 and the reverse gear 23.

The forward gear 22 includes a through-hole 221. The reverse gear 23 includes a through-hole 231. The propeller shaft 12 is inserted through the through-hole 221 of the forward gear 22 and the through-hole 231 of the reverse gear 23. The forward gear 22 is disposed rotatably with respect to the propeller shaft 12. The reverse gear 23 is disposed rotatably with respect to the propeller shaft 12.

The dog clutch 24 switches the connection of the forward gear 22 and the reverse gear 23 with the propeller shaft 12. The dog clutch 24 is disposed between the forward gear 22 and the reverse gear 23. The dog clutch 24 is non-rotatable with respect to the propeller shaft 12. Accordingly, the dog clutch 24 rotates with the propeller shaft 12. Additionally, the dog clutch is disposed movably in the axial direction of the propeller shaft 12, with respect to the propeller shaft 12.

The dog clutch 24 is connected to the shifter 14. The dog clutch 24 is movable between a forward position, a neutral position, and a reverse position in the axial direction of the propeller shaft 12, in accordance with the operation of the shifter 14. When in the forward position, the dog clutch 24 couples the forward gear 22 with the propeller shaft 12. As a result, the rotation of the drive shaft 11 is transmitted to the propeller shaft 12 via the drive gear 21 and the forward gear 22.

When in the reverse position, the dog clutch 24 couples the reverse gear 23 with the propeller shaft 12. As a result, the rotation of the drive shaft 11 is transferred to the propeller shaft 12 via the drive gear 21 and the reverse gear 23. When in the neutral position, the dog clutch 24 couples neither the forward gear 22 nor the reverse gear 23 with the propeller shaft 12. As a result, the forward gear 22 and the reverse gear 23 idle with respect to the propeller shaft 12, and the rotation of the drive shaft 11 is not transmitted to the propeller shaft 12.

Figure 3:
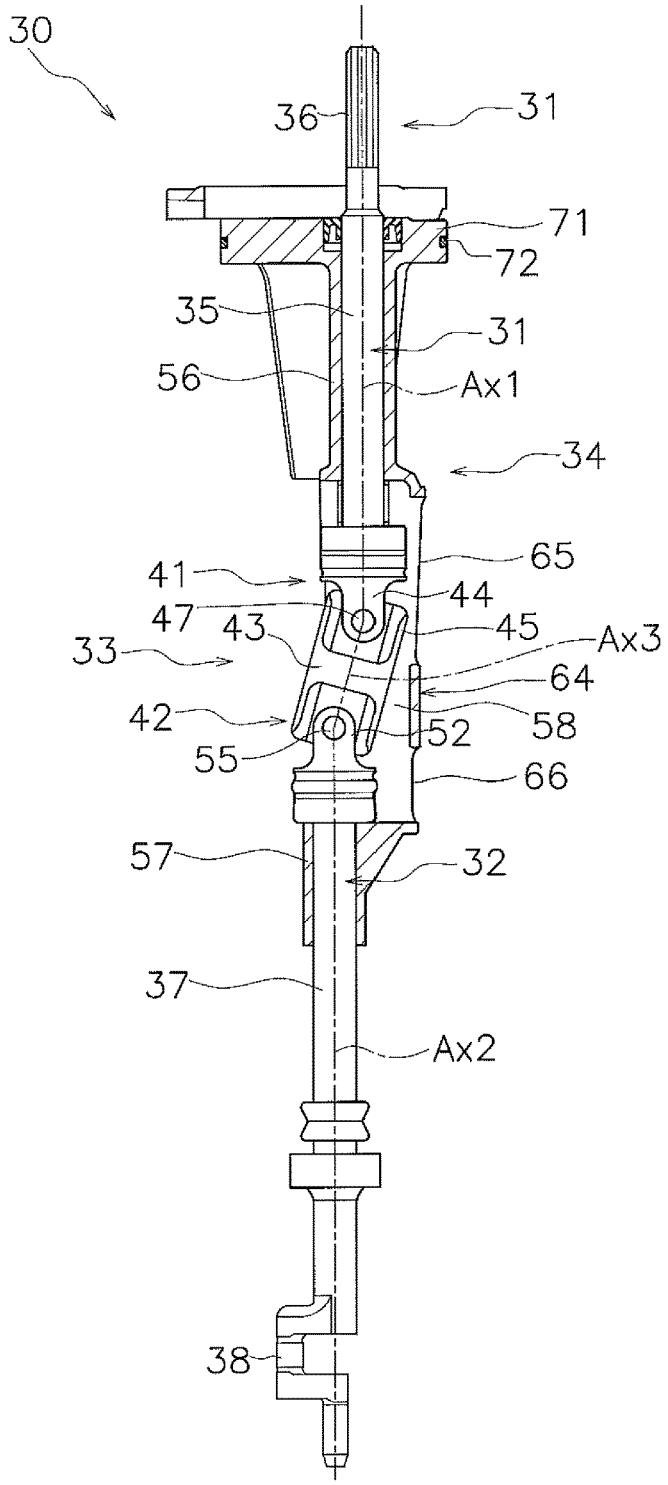
FIG. 3 is a side view of a shift rod unit.
Figure 4:
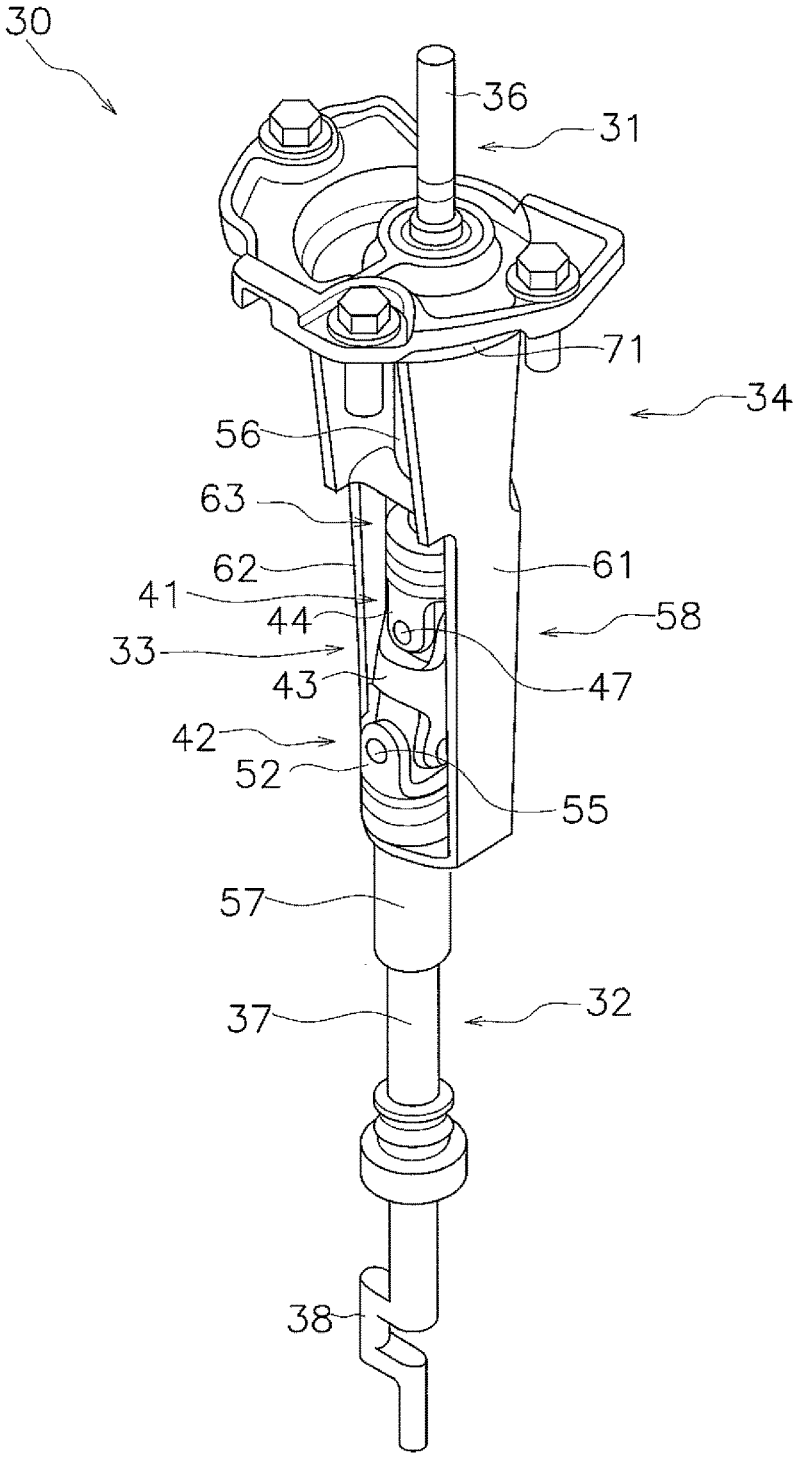
FIG. 4 is a perspective view of the shift rod unit.
Figure 5:
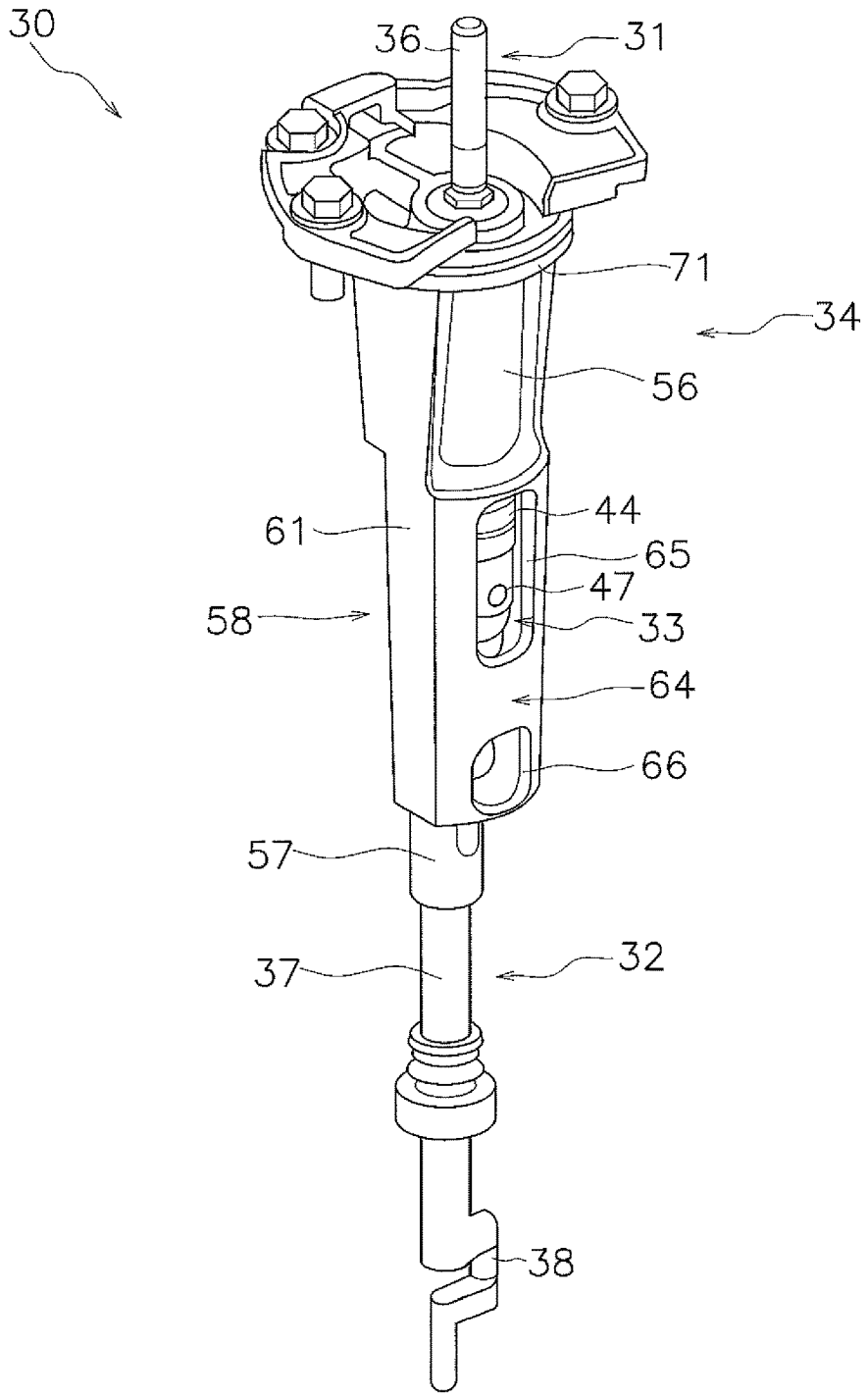
FIG. 5 is a perspective view of the shift rod unit.
Figure 6:
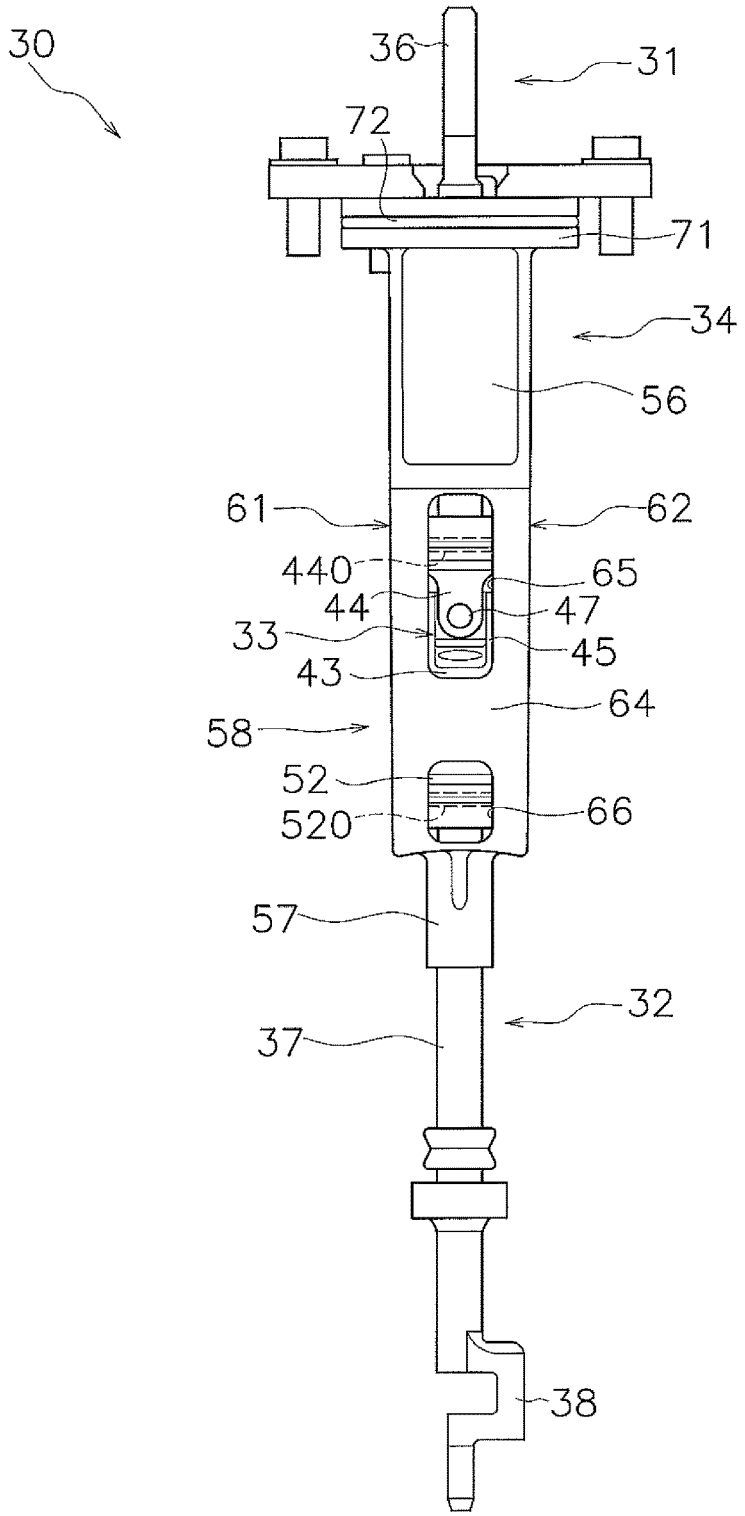
FIG. 6 is a rear view of the shift rod unit.

A portion of the shift rod 15 is disposed within the lower case 3*b*. Specifically, the shift rod 15 includes a shift rod unit 30. The shift rod unit 30 is disposed within the lower case 3*b*. FIG. 3 is a side view of the shift rod unit 30. FIGS. 4 and 5 are perspective views of the shift rod unit 30. FIG. 6 is a rear view of the shift rod unit 30. As illustrated in FIGS. 3 to 6, the shift rod unit 30 includes a first rod 31, a second rod 32, a joint 33, and a bracket 34.

The first rod 31 and the second rod 32 extend in the vertical direction. The first rod 31 and the second rod 32 are disposed in front of the drive shaft 11. A portion of the first rod 31 protrudes upward from the lower case 3*b*. Specifically, the first rod 31 includes a first rod main body 35 and a coupling 36. The first rod main body 35 is disposed within the lower case 3*b*. The coupling 36 extends upward from the first rod main body 35. The coupling 36 protrudes upward from the lower case 3*b*. The coupling 36 includes a plurality of key grooves. The coupling 36 is joined to the other portion of the shift rod 15 positioned above the lower case 3*b*.

The second rod 32 is a separate body from the first rod 31. The second rod 32 is positioned below the first rod 31. The second rod 32 is disposed in front of the gear mechanism 13. The second rod 32 is connected to the shifter 14. Specifically, the second rod 32 includes a second rod main body 37 and a cam 38. The cam 38 is disposed below the second rod main body 37. The shifter 14 is connected to the cam 38.

The second rod 32 is disposed eccentrically with respect to the first rod 31. The second rod 32 has an axis Ax2 spaced apart from an axis Ax1 of the first rod 31 in the front-back direction. Specifically, the axis Ax2 of the second rod 32 is located forward of the axis Ax1 of the first rod 31. Accordingly, the second rod 32 is spaced farther from the drive shaft 11 than the first rod 31.

Figure 7:
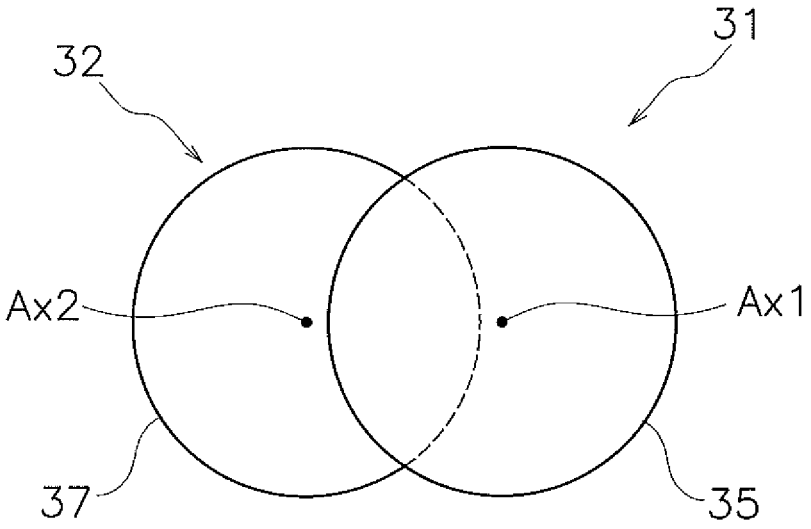
FIG. 7 is a plan view schematically illustrating positions of a first rod and a second rod.

FIG. 7 is a plan view schematically illustrating the positions of the first rod 31 and the second rod 32. As illustrated in FIG. 7, when viewed in a plan view, the second rod 32 overlaps with a portion of the first rod 31. When viewed in a plan view, the second rod main body 37 overlaps with a portion of the first rod main body 35. When viewed in a plan view, the area of the portion of the first rod main body 35 that overlaps with the second rod main body 37 is smaller than the area of the portion of the first rod main body 35 that does not overlap with the second rod main body 37. The first rod main body 35 preferably has an outer diameter that is the same as an outer diameter of the second rod main body 37. Alternatively, the outer diameter of the first rod main body 35 and the outer diameter of the second rod main body 37 may be different.

When viewed in a plan view, the axis Ax1 of the first rod 31 does not overlap with the second rod main body 37. When viewed in a plan view, the axis Ax1 of the first rod 31 is located rearward of the second rod main body 37. When viewed in a plan view, the second rod 32 does not overlap with the first rod main body 35. When viewed in a plan view, the axis Ax2 of the second rod 32 is located forward of the first rod main body 35.

The joint 33 is disposed within the lower case 3*b*. The joint 33 is at least partially disposed between the lower bearing 17 and the upper bearing 18 in the vertical direction. The joint 33 connects the first rod 31 to the second rod 32. The joint 33 transmits the rotation of the first rod 31 to the second rod 32. The joint 33 includes a first universal joint 41, a second universal joint 42, and an intermediate shaft 43.

Figure 8:
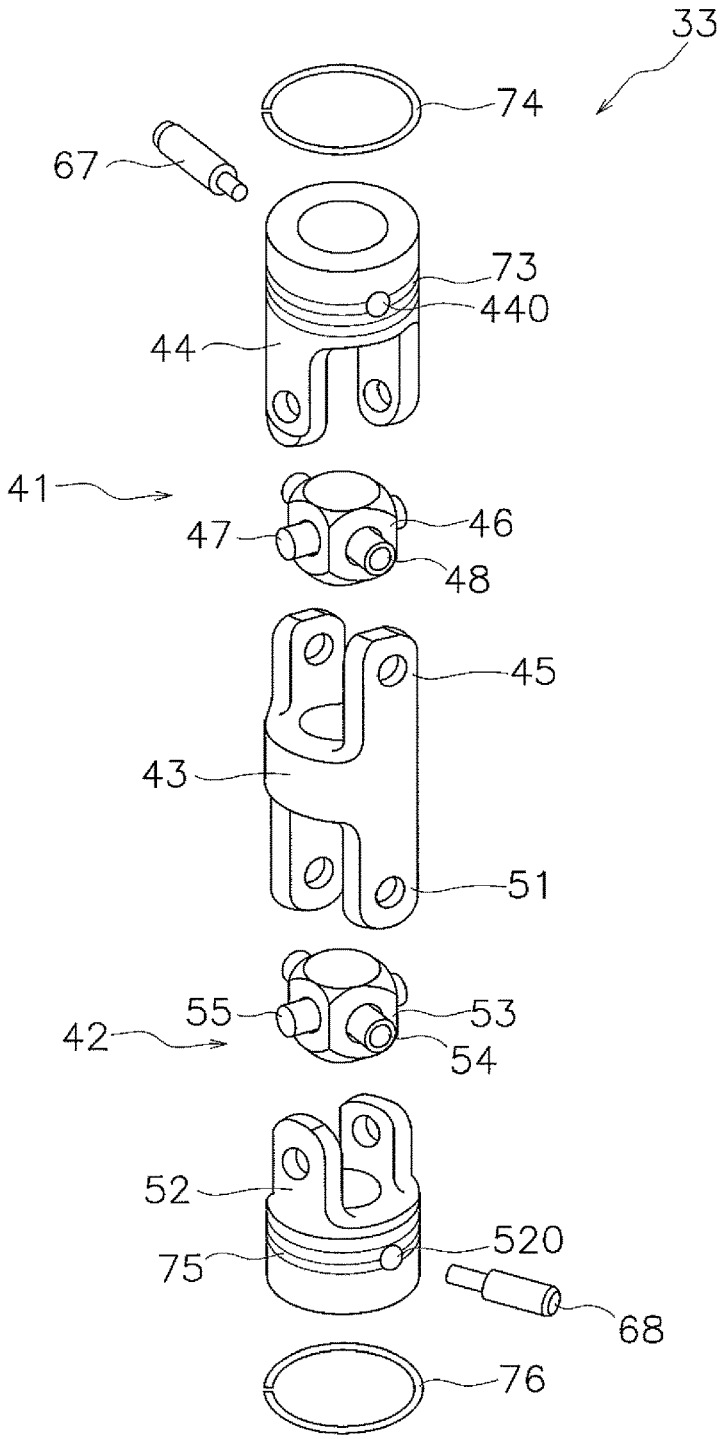
FIG. 8 is an exploded perspective view of a joint.

FIG. 8 is an exploded perspective view of the joint 33. As illustrated in FIG. 8, the first universal joint 41 includes a first yoke 44, a second yoke 45, and a first spider 46. The first yoke 44 is connected to the first rod 31. Specifically, the first yoke 44 is connected to a lower end of the first rod main body 35.

The first yoke 44 includes a pin hole 440 extending in a direction perpendicular or substantially perpendicular to an axis of the first yoke 44. While not illustrated in the drawings, the first rod 31 also includes a pin hole. A pin 67 is inserted through the pin hole 440 in the first yoke 44 and the pin hole in the first rod 31, thus fixing the first yoke 44 and the first rod 31 to each other. A set pin groove 73 is provided in the outer circumferential surface of the first yoke 44. The pin hole 440 is disposed in the set pin groove 73. A ring spring 74 illustrated in FIG. 8 is attached to the set pin groove 73.

The second yoke 45 is connected to the intermediate shaft 43. The first spider 46 includes a first shaft 47 and a second shaft 48. The first shaft 47 and the second shaft 48 are cross-shaped or substantially cross-shaped. The first shaft 47 is rotatably supported by the first yoke 44. The second shaft 48 is rotatably supported by the second yoke 45.

The second universal joint 42 includes a third yoke 51, a fourth yoke 52, and a second spider 53. The third yoke 51 is connected to the intermediate shaft 43. The second spider 53 includes a third shaft 54 and a fourth shaft 55. The third shaft 54 and the fourth shaft 55 are cross-shaped or substantially cross-shaped. The third shaft 54 is rotatably supported by the third yoke 51. The fourth shaft 55 is rotatably supported by the fourth yoke 52.

The fourth yoke 52 is connected to the second rod 32. Specifically, the fourth yoke 52 is connected to an upper end of the second rod main body 37. The fourth yoke 52 includes a pin hole 520 extending in a direction perpendicular or substantially perpendicular to an axis of the fourth yoke 52. While not illustrated in the drawings, the second rod 32 also includes a pin hole. A pin 68 is inserted through the pin hole 520 in the fourth yoke 52 and the pin hole in the second rod 32, thus fixing the fourth yoke 52 and the second rod 32 to each other.

A set pin groove 75 is provided in the outer circumferential surface of the fourth yoke 52. The pin hole 520 is disposed in the set pin groove 75. A ring spring 76 illustrated in FIG. 8 is attached to the set pin groove 75.

The intermediate shaft 43 connects the first universal joint 41 to the second universal joint 42. The intermediate shaft 43 is disposed between the second yoke 45 and the third yoke 51. The intermediate shaft 43 connects the second yoke 45 to the third yoke 51. In the present preferred embodiment, the intermediate shaft 43 is integral and unitary with the second yoke 45 and the third yoke 51. Alternatively, the intermediate shaft 43 may be a separate body from the second yoke 45 and the third yoke 51, and may be fixed to the second yoke 45 and the third yoke 51.

As illustrated in FIG. 3, the first yoke 44 is disposed concentrically with the first rod 31. The axis of the first yoke 44 extends in the up-down direction, similar to the first rod 31. The axis of the first yoke 44 is disposed concentrically with the axis Ax1 of the first rod 31.

The fourth yoke 52 is disposed concentrically with the second rod 32. The axis of the fourth yoke 52 extends in the up-down direction, similar to the second rod 32. The axis of the fourth yoke 52 is disposed concentrically with the axis Ax2 of the second rod 32.

An axis Ax3 of the intermediate shaft 43 is inclined with respect to the axis Ax1 of the first rod 31. The axis Ax3 of the intermediate shaft 43 is inclined with respect to the axis Ax2 of the second rod 32. The axis Ax3 of the intermediate shaft 43 is inclined with respect to the axis of the first yoke 44. The axis Ax3 of the intermediate shaft 43 is inclined with respect to the axis of the fourth yoke 52.

The bracket 34 supports the shift rod 15. The bracket 34 integrally supports the first rod 31, the joint 33, and the second rod 32. Thus, the shift rod unit 30 includes the first rod 31, the joint 33, the second rod 32, and the bracket 34.

The bracket 34 includes a first bearing 56, a second bearing 57, and a bracket main body 58. The first bearing 56 rotatably supports the first rod 31. Specifically, the first bearing 56 surrounds the periphery of the first rod main body 35, thus rotatably supporting the first rod main body 35. The second bearing 57 is positioned below the first bearing 56. The second bearing 57 rotatably supports the second rod 32. Specifically, the second bearing 57 surrounds the periphery of the second rod main body 37, thus rotatably supporting the second rod main body 37.

The bracket main body 58 is disposed between the first bearing 56 and the second bearing 57, and is connected to the first bearing 56 and the second bearing 57. The bracket main body 58 houses the joint 33. As illustrated in FIG. 4, the bracket main body 58 includes a first side surface 61 and a second side surface 62. The first side surface 61 is disposed to the left of the joint 33. The second side surface 62 is disposed to the right of the joint 33. When viewed from the side, the first side surface 61 and the second side surface 62 overlap with the joint 33.

The bracket main body 58 includes an opening 63 at a position facing the joint 33. The opening 63 is disposed in front of the joint 33. The joint 33 is able to be installed within the bracket main body 58 through the opening 63. The bracket main body 58 includes a back surface 64. The back surface 64 is disposed behind the joint 33.

The back surface 64 includes a first hole 65 and a second hole 66. The first hole 65 faces at least a portion of the joint 33. The first hole 65 faces the portion where the first yoke 44, the first spider 46, and the second yoke 45 connect.

The first hole 65 is disposed so as to face the pin hole 440 in the first yoke 44. Accordingly, to insert the pin 67 into the pin hole 440 in the first yoke 44 when assembling the shift rod unit 30, the first yoke 44 is supported by disposing a jig through the first hole 65.

The second hole 66 is disposed below the first hole 65. The second hole 66 is disposed so as to face the pin hole 520 in the fourth yoke 52. Accordingly, to insert the pin 68 into the pin hole 520 in the fourth yoke 52 when assembling the shift rod unit 30, the fourth yoke 52 is supported by disposing a jig through the second hole 66.

The bracket 34 further includes a connector 71. The connector 71 is disposed above the first bearing 56, and is connected to the first bearing 56. The connector 71 protrudes to the front, back, left, and right from the first bearing 56. The connector 71 is attached to the lower case 3*b*.

Specifically, as illustrated in FIG. 2, the lower case 3*b* includes a hole 300 in its top surface. The shift rod unit 30 is disposed in the lower case 3*b* through the hole 300. The connector 71 is attached to the hole 300, thus closing the hole 300. An oil shield 72 seals space between the connector 71 and the first rod 31. An upper portion of the first rod 31 protrudes upward from the connector 71. The portion of the bracket 34 below the connector 71 is disposed within the lower case 3*b*.

In one example, the bracket 34 is made from resin. Alternatively, the bracket 34 may be made from other materials such as metal. The first bearing 56, the bracket main body 58, the second bearing 57, and the connector 71 are preferably integral and unitary. Alternatively, a portion or all of the first bearing 56, the bracket main body 58, the second bearing 57, and the connector 71 may be separate bodies.

As illustrated in FIG. 2, the lower case 3*b* includes a first shaft chamber 301, a second shaft chamber 302, and a gear chamber 303. The first shaft chamber 301 extends in the up-down direction within the lower case 3*b*. The drive shaft 11 is partially disposed in the first shaft chamber 301. The upper bearing 18 and the lower bearing 17 are disposed in the first shaft chamber 301.

The second shaft chamber 302 extends in the up-down direction within the lower case 3*b*. The second shaft chamber 302 is disposed in front of the first shaft chamber 301. The shift rod unit 30 is disposed in the second shaft chamber 302. The second shaft chamber 302 is in communication with the hole 300 in the top surface of the lower case 3*b*.

The gear chamber 303 is disposed below the first shaft chamber 301 and the second shaft chamber 302. The gear chamber 303 is in communication with the first shaft chamber 301 and the second shaft chamber 302. The gear mechanism 13 is disposed in the gear chamber 303. The cam 38 of the second rod 32 is disposed in the gear chamber 303.

The lower case 3*b* includes a first oil passage 304 and a second oil passage 305. The first oil passage 304 and the second oil passage 305 connect the first shaft chamber 301 to the second shaft chamber 302.

The first oil passage 304 extends forward and upward from the first shaft chamber 301 toward the second shaft chamber 302. The first oil passage 304 opens at a position facing the lower bearing 17 in the first shaft chamber 301. The first oil passage 304 opens at a position facing the joint 33 in the second shaft chamber 302. The first oil passage 304 opens at a position facing the first hole 65 in the second shaft chamber 302. However, the arrangement of the first oil passage 304 may be changed.

The second oil passage 305 is disposed above the first oil passage 304. While a plurality of second oil passages 305 are depicted in FIG. 2, only one second oil passage 305 may be provided. The second oil passage 305 extends forward and downward from the first shaft chamber 301 toward the second shaft chamber 302.

The second oil passage 305 opens at a position in the first shaft chamber 301 facing the upper bearing 18. The second oil passage 305 opens at a position in the second shaft chamber 302 above the joint 33. The second oil passage 305 opens at a position in the second shaft chamber 302 facing the first bearing 56. However, the arrangement of the second oil passage 305 may be changed.

The lower case 3*b* is filled with a lubricant. The lubricant circulates in the first shaft chamber 301, the second shaft chamber 302, and the gear chamber 303. In one example, the flow of the lubricant is generated by the rotation of the drive shaft 11. The lubricant flows from the gear chamber 303 to the first shaft chamber 301. As a result, the drive shaft 11 is lubricated. The lubricant flows through the first oil passage 304 and into the second shaft chamber 302.

Additionally, the lubricant flows from the first shaft chamber 301, through the second oil passage 305, and into the second shaft chamber 302. As a result, the shift rod unit 30 is lubricated. In particular, the lubricant flows through the first hole 65 and around the joint 33. As a result, the joint 33 is effectively lubricated. The lubricant flows from the second shaft chamber 302 into the gear chamber 303, and then from the gear chamber 303 back to the first shaft chamber 301.

With the outboard motor 1 according to a preferred embodiment described above, the second rod 32 is disposed eccentrically with respect to the first rod 31. Therefore, compared to a configuration in which the shift rod 15 has a straight line shape, it is possible to provide a distance between the second rod 32 and the drive shaft 11 while avoiding substantial changes to the structure of the outboard motor 1. As a result, the durability of the drive system is improved.

Additionally, when viewed in a plan view, the second rod 32 overlaps with at least a portion of the first rod 31. That is, the first rod 31 and the second rod 32 are disposed in closer proximity to each other than in a configuration in which the first rod 31 and the second rod 32 are connected by gears. As a result, an increase in the size of the outboard motor 1 is prevented.

While preferred embodiments of the present invention have been described, the present invention should not be construed as being limited thereto, and various types of modifications may be made without departing from the spirit or scope of the general inventive concept of the present invention.

The structure of the gear mechanism 13 is not limited to the preferred embodiments described above and may be modified. For example, the forward, reverse, and neutral states of the gear mechanism 13 may be switched using a plurality of clutch plates.

Figure 9A:
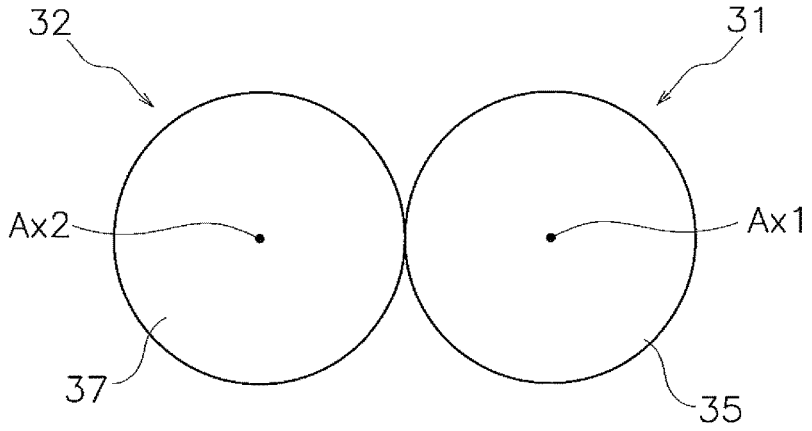
FIGS. 9A and 9B are plan views schematically illustrating positions of a first rod and a second rod according to a preferred embodiment of the present invention.
Figure 9B:
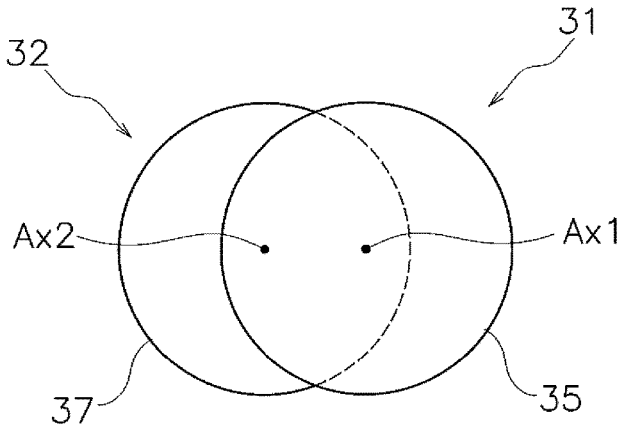

Additionally, the positions of the first rod 31 and the second rod 32 are not limited to the preferred embodiments described above and may be modified. For example, as illustrated in FIG. 9A, when viewed in a plan view, the second rod 32 may contact the first rod 31. Alternatively, as illustrated in FIG. 9B, when viewed in a plan view, the first rod 31 may overlap with the axis Ax2 of the second rod 32. Additionally, when viewed in a plan view, the second rod 32 may overlap with the axis Ax1 of the first rod 31. The axis Ax2 of the second rod 32 may be spaced apart from the axis Ax1 of the first rod 31 in a left-right direction.

Furthermore, the joint 33 is not limited to a universal joint and may include a joint such as an Oldham coupling, a flexible joint, or a Schmidt joint. The structure of the joint 33 is not limited to the preferred embodiments described above and may be modified. For example, the joint 33 may be disposed within the upper case 3*a*.

Moreover, the structure of the bracket 34 is not limited to the preferred embodiments described above and may be modified. For example, the connector 71 may be omitted. Alternatively, the bracket 34 may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
an engine;
a drive shaft extending downward from the engine;
a propeller shaft extending in a front-back direction of the outboard motor;
a gear mechanism connecting the drive shaft to the propeller shaft;
a shifter that switches a connection of the gear mechanism; and
a shift rod that operates and is connected to the shifter; wherein
the shift rod includes:
a first rod extending in a vertical direction;
a second rod extending in the vertical direction, the second rod located below the first rod, disposed eccentrically with respect to the first rod, and, when viewed in a plan view, overlapped with at least a portion of the first rod or in contact with the first rod; and
a joint connecting the first rod and the second rod; and
the joint includes a universal joint.

2. The outboard motor according to claim 1, wherein the second rod is located farther from the drive shaft than the first rod.

3. The outboard motor according to claim 1, wherein an axis of the second rod is spaced apart from an axis of the first rod in the front-back direction.

4. The outboard motor according to claim 1, wherein the second rod is disposed forward of the gear mechanism and connected to the shifter.

5. The outboard motor according to claim 1, wherein an axis of the second rod is located forward of an axis of the first rod.

6. The outboard motor according to claim 1, further comprising:
a lower case that houses the propeller shaft and the gear mechanism; wherein
the joint is disposed within the lower case.

7. The outboard motor according to claim 1, further comprising:
a lower bearing disposed above the gear mechanism and rotatably supporting the drive shaft; and
an upper bearing disposed above the lower bearing and rotatably supporting the drive shaft; wherein
the joint is disposed between the lower bearing and the upper bearing in the vertical direction.

8. An outboard motor comprising:
an engine;
a drive shaft extending downward from the engine;
a propeller shaft extending in a front-back direction of the outboard motor;
a gear mechanism connecting the drive shaft to the propeller shaft;
a shifter that switches a connection of the gear mechanism; and
a shift rod that operates and is connected to the shifter; wherein
the shift rod includes:
a first rod extending in a vertical direction;
a second rod extending in the vertical direction, the second rod located below the first rod, disposed eccentrically with respect to the first rod, and, when viewed in a plan view, overlapped with at least a portion of the first rod or in contact with the first rod; and
a joint connecting the first rod and the second rod;
the outboard motor further includes a bracket supporting the shift rod; and
the bracket includes:
a first bearing rotatably supporting the first rod;
a second bearing disposed below the first bearing and rotatably supporting the second rod; and
a main body connected to the first bearing and the second bearing, and containing the joint.

9. The outboard motor according to claim 8, wherein the first bearing, the main body, and the second bearing are integral and unitary.

10. The outboard motor according to claim 8, further comprising:
a lower case that houses the propeller shaft and the gear mechanism; wherein
the bracket is disposed within the lower case; and
the bracket further includes a connector attached to the lower case.

11. The outboard motor according to claim 8, wherein the main body includes an opening at a position facing the joint.

12. An outboard motor comprising:
an engine;
a drive shaft extending downward from the engine;
a propeller shaft extending in a front-back direction of the outboard motor;
a gear mechanism connecting the drive shaft to the propeller shaft;
a shifter that switches a connection of the gear mechanism; and
a shift rod that operates and is connected to the shifter; wherein
the shift rod includes:
a first rod extending in a vertical direction;
a second rod extending in the vertical direction, the second rod located below the first rod, disposed eccentrically with respect to the first rod, and, when viewed in a plan view, overlapped with at least a portion of the first rod or in contact with the first rod; and
a joint connecting the first rod and the second rod; and
the joint includes:
a first yoke connected to the first rod;
a second yoke connected to the second rod;
an intermediate shaft disposed between the first yoke and the second yoke;
a first spider including a shaft that is cross-shaped or substantially cross-shaped, the first spider being rotatably supported by the first yoke and rotatably supported by the intermediate shaft; and a second spider including a shaft that is cross-shaped or substantially cross-shaped, the second spider being rotatably supported by the second yoke and rotatably supported by the intermediate shaft.

* * * * *